US009163642B2

(12) United States Patent
Masutani

(10) Patent No.: US 9,163,642 B2
(45) Date of Patent: Oct. 20, 2015

(54) IMPELLER AND ROTARY MACHINE

(75) Inventor: Jo Masutani, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 1030 days.

(21) Appl. No.: 13/259,286

(22) PCT Filed: Feb. 18, 2010

(86) PCT No.: PCT/JP2010/001056

§ 371 (c)(1),
(2), (4) Date: Sep. 23, 2011

(87) PCT Pub. No.: WO2011/007467

PCT Pub. Date: Jan. 20, 2011

(65) Prior Publication Data

US 2012/0100003 A1 Apr. 26, 2012

(30) Foreign Application Priority Data

Jul. 13, 2009 (JP) ..... 2009-164781

(51) Int. Cl.

| | |
|---|---|
| ***F04D 29/68*** | (2006.01) |
| ***F04D 29/24*** | (2006.01) |
| ***F04D 29/28*** | (2006.01) |
| ***F04D 29/30*** | (2006.01) |

(52) U.S. Cl.

CPC ..... *F04D 29/68* (2013.01); *F04D 29/24* (2013.01); *F04D 29/281* (2013.01); *F04D 29/30* (2013.01)

(58) Field of Classification Search

CPC ..... F04D 29/2272; F04D 29/24; F04D 29/68; F04D 29/30; F04D 29/281

See application file for complete search history.

(56) References Cited

U.S. PATENT DOCUMENTS

2007/0253834 A1 11/2007 Ogino et al.

FOREIGN PATENT DOCUMENTS

| | | |
|---|---|---|
| CN | 1500998 | 6/2004 |
| CN | 1886596 | 12/2006 |
| JP | 2003-013895 | 1/2003 |
| JP | 2005-163640 | 6/2005 |
| JP | 2005-180372 | 7/2005 |
| JP | 2006-002689 | 1/2006 |
| JP | 2006-77723 | 3/2006 |
| JP | 2007-192034 | 8/2007 |

OTHER PUBLICATIONS

Chinese Office Action issued Aug. 5, 2013 in Chinese Patent Application No. 201080015579.9 with English translation.

International Search Report issued May 25, 2010 in International (PCT) Application No. PCT/JP2010/001056 w/English translation.

Written Opinion of the International Searching Authority issued May 25, 2010 in International (PCT) Application No. PCT/JP2010/001056 w/English translation.

*Primary Examiner* — Nathaniel Wiehe
*Assistant Examiner* — Jeffrey A Brownson
(74) *Attorney, Agent, or Firm* — Wenderoth, Lind & Ponack, L.L.P.

(57) ABSTRACT

An impeller of a rotary machine, in which a direction of flow is configured to gradually change from an axial direction to a radial direction as the flow goes from an interior in the radial direction of a fluid flow passage to an exterior in the radial direction of the fluid flow passage, includes: a hub surface defining at least a portion of the fluid flow passage; a blade surface defining at least a portion of the fluid flow passage; and a bulge being disposed so as to bulge toward the interior of the fluid flow passage at a corner where the hub surface, which is located at a rear half on an outlet side of the fluid flow passage, is in contact with the blade surface.

18 Claims, 10 Drawing Sheets

IMPELLER AND ROTARY MACHINE

BACKGROUND OF INVENTION

1. Technical Field

The present invention relates to an impeller and a rotary machine, and particularly, to a flow passage shape thereof.

Priority is claimed on Japanese Patent Application No. 2009-164781 filed on Jul. 13, 2009, the contents of which are incorporated herein by reference.

2. Background Art

In centrifugal or mixed-flow compressors used for rotary machines, such as an industrial compressor, a turbo refrigerator, and a small gas turbine, improvements in performance are required, and particularly, improvements in the performance of the impeller that is a key component of the compressors are required. Thus, in recent years, in order to improve the performance of an impeller, an impeller in which a recess is provided at a leading edge between tip hubs of the blades to effectively suppress secondary flow or flaking has been proposed (for example, refer to PTL 1).

Additionally, there are impellers (for example, refer to PTLs 2 and 3) in which turbulence is caused in a flow along the hub surface by forming a plurality of grooves in the hub surface between blades such that a boundary layer of the flow along the hub surface is not expanded, in order to improve the performance of a centrifugal or mixed-flow impeller, and in which a plurality of small blades is provided between blades in order to prevent local concentration of a boundary layer.

RELATED ART DOCUMENT

Patent Literature

[PTL 1] JP-A-2006-2689
[PTL 2] JP-A-2005-163640
[PTL 3] JP-A-2005-180372

Technical Problem

In an impeller 201 of a related-art centrifugal compressor shown in FIGS. 9 to 11, a fluid flow passage 210 is formed by a pressure surface p and a suction surface n of adjacent blades 203 formed on a hub surface 204 of a hub 202, the hub surface 204, and a shroud surface 205. For example, if the hub 202 shown in FIG. 10 rotates around an axis O, a fluid flows in along an axial direction from an inlet 206 arranged on the inside in the radial direction. Thereafter, the fluid moves while the direction of the flow changes from an axial direction to a radial direction along the fluid flow passage 210. Finally, the fluid is discharged along the radial direction from an outlet 207 that is arranged on the outside in the radial direction. In addition, the rotational direction of an impeller 201 is shown by an arrow in FIG. 9.

As such, since the direction of flow of the fluid flow passage 210 changes in a direction along the radial direction from a direction along the axis O as it goes from the inside in the radial direction of the impeller 201 to the outside in the radial direction thereof, a boundary layer grows on the shroud surface 205 in the vicinity of the outlet 207 of the impeller 201. Additionally, since the pressure on the suction surface n of the blade 203 is minimized, the boundary layer is drawn close to the shroud surface 205 and the suction surface n, and is gradually accumulated, and a stagnation k of a low-energy fluid is accumulated on the negative surface n side on the shroud surface 205 in the vicinity of the outlet 207.

Moreover, since the fluid easily flakes inside of a curved portion of a flow, the accumulation of the stagnation k of the low-energy fluid and the easy flaking of the flow act simultaneously, and the range of the stagnation k of the low-energy fluid accumulated in the vicinity of a corner formed by the suction surface n and the shroud surface 205 is further expanded. Although the centrifugal compressor has been described as an example in the above-described FIGS. 9 to 11, the stagnation k of the low-energy fluid is similarly accumulated for the same reason also in a fluid flow passage of a mixed-flow compressor. The stagnation k of the low-energy fluid gradually expands toward the outlet 207, and thereby, a flow loss is caused from a rear half 211 on the outlet 207 side of the fluid flow passage 210 to the outlet 207.

Additionally, since the stagnation k of the low-energy fluid becomes large as the flow rate decreases, this also becomes a factor that degrades the performance on the side with a small flow rate.

SUMMARY OF INVENTION

The invention has been made in view of the above circumstances, and the object thereof is to provide an impeller and a rotary machine that can reduce a stagnation of a low-energy fluid produced at a rear half of a fluid flow passage, to reduce a flow loss.

Solution to Problem

The invention adopts the following configurations in order to solve the above problems to achieve the object concerned.

An impeller (for example, the impeller 1 in the embodiment) related to the invention is an impeller of a rotary machine in which the direction of flow gradually changes from an axial direction to a radial direction as it goes from the inside in the radial direction of a fluid flow passage (for example, the impeller flow passage 10 in the embodiment) to the outside in the radial direction thereof. The impeller includes a hub surface (for example, the hub surface 4 in the embodiment) constituting at least a portion of the fluid flow passage; a blade surface (for example, the pressure surface p or the suction surface n in the embodiment) constituting at least a portion of the fluid flow passage; and a bulge (for example, the bulge b in the embodiment) that bulges toward the inside of the fluid flow passage at a corner (for example, the corner 12 or 22 in the embodiment) where the hub surface, which is located at a rear half (for example, the rear half 11 in the embodiment) that is one of a front half on an inlet (for example, the inlet 6 in the embodiment) side of the fluid flow passage and the rear half on an outlet (for example, the outlet 7 in the embodiment) side thereof, comes in contact with the blade surface.

According to the impeller related to the invention, the bulge is provided so as to bulge toward the inside of the fluid flow passage from the corner where the hub surface comes in contact with the blade surface at the rear half of the fluid flow passage. Thereby, a fluid that flows through the fluid flow passage flows over the bulge at the rear half, and a stagnation of a low-energy fluid produced at a facing surface of the bulge is pressed against a high-energy fluid that has ridden over the bulge, and is reduced. Therefore, a flow loss caused by accumulation of the stagnation of the low-energy fluid can be reduced. Here, although the low-energy fluid tends to increase as the flow rate decreases, the flow velocity is increased by the bulge. Thus, particularly when a fluid with a low flow rate flows in, the efficiency is improved, and stall of the fluid is further suppressed. Thus, the surge margin is also expanded.

Additionally, the strength of the portion where the blade formed with the bulge comes in contact with the hub can be increased by providing the bulge at the corner. Moreover, an increase in the number of parts can be suppressed by being formed integrally with the hub and the blade.

The corner in the impeller of the above invention may be a corner (for example, the corner 12 in the embodiment) formed by the suction surface of the blade, and the hub surface.

In this case, since the bulge is provided at the corner between the suction surface, which is relatively close to the stagnation of the low-energy fluid that is accumulated near the corner between the suction surface of the blade and the shroud surface, the low-energy fluid can be efficiently pressed by the high-energy fluid that has ridden over the bulge, and can be reduced.

The corner in the impeller of the above invention may be a corner (for example, the corner 22 in the embodiment) formed by the pressure surface of the blade, and the hub surface.

In this case, even in a case where the bulge is provided at the corner formed by the pressure surface of the blade, and the hub surface, a low-energy fluid can be pressed by a fluid that has ridden over the bulge, and can be reduced. Additionally, in a case where bulges are provided at both the corner between the pressure surface and the hub surface and the corner between the suction surface and the hub surface, the low-energy fluid can be further reduced.

In the impeller of the above invention, a scraped portion (for example, the scraped portion 13 in the embodiment) may be provided on either the upstream or the downstream of the fluid flow passage of the bulge to smoothly connect between the bulge, and the hub surface and the blade surface.

In this case, since the bulge, the hub surface, and the suction surface are smoothly connected together by the scraped portion, the flow loss when a fluid flows over the bulge can be suppressed.

Additionally, the rotary machine related to the invention includes the impeller of the above invention.

According to the rotary machine related to the invention, since the impeller of the invention mentioned above is included, the loss of the rotary machine can be further reduced.

Advantageous Effects of Invention

According to the impeller and rotary machine related to the invention, by providing the bulge at the corner where the hub surface comes in contact with the blade surface, the stagnation of the low-energy fluid produced along the shroud surface near the suction surface of the blade of the rear half of the fluid flow passage can be reduced when a fluid that flows through the fluid flow passage flows over the bulge. Therefore, there is an advantage that a flow loss caused as the stagnation of the low-energy fluid expands can be reduced.

DESCRIPTION OF EMBODIMENTS

Figure 1:
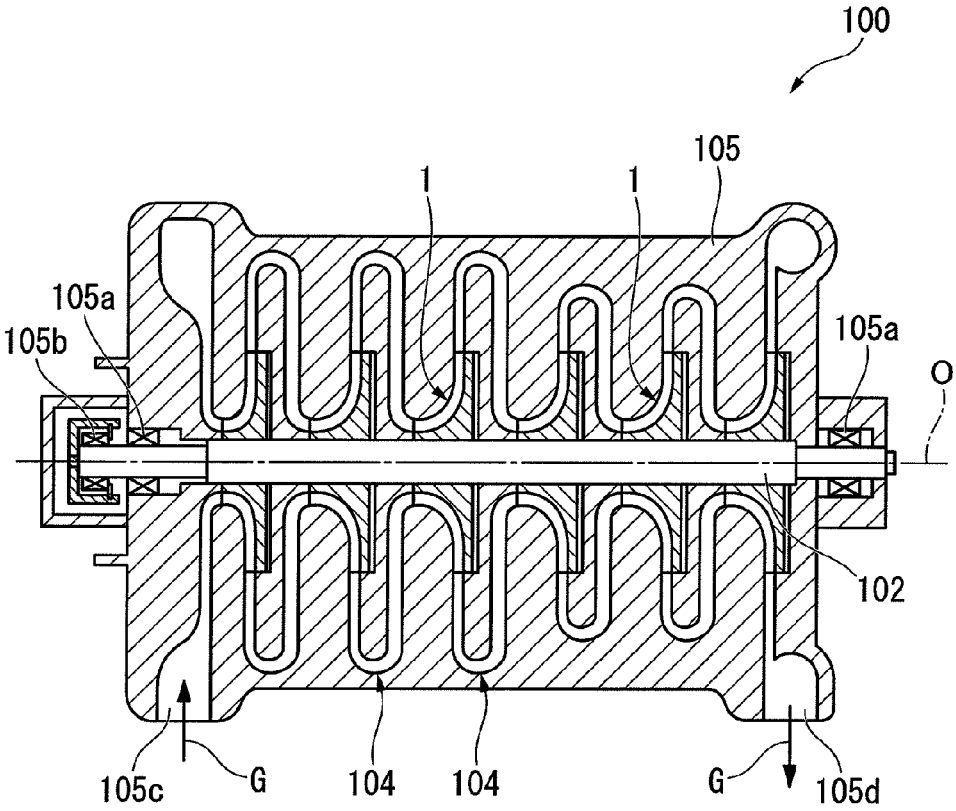
FIG. 1 is a cross-sectional view of a centrifugal compressor in the embodiment of the invention.

Next, an impeller and a rotary machine in the embodiment of the invention will be described, referring to the drawings. The impeller of this embodiment will be described taking an impeller of a centrifugal compressor that is a rotary machine as an example.

A centrifugal compressor 100 that is a rotary machine of the present embodiment, as shown in FIG. 1, is mainly constituted by, as an example, a shaft 102 that is rotated around an axis O, an impeller 1 that is attached to the shaft 102 and compresses process gas (gas) G using a centrifugal force, and a casing 105 that rotatably supports the shaft 102 and is formed with a flow passage 104 that allows the process gas G to pass from the upstream to the downstream.

A casing 105 is formed so as to form a substantially columnar outline, and the shaft 102 is arranged so as to pass through a center. Journal bearings 105*a* are provided at both ends of the shaft 102 in an axial direction, and a thrust bearing 105*b* is provided at one end. The journal bearings 105*a* and the thrust bearing 105*b* rotatably support the shaft 102. That is, the shaft 102 is supported by the casing 105 via the journal bearings 105*a* and the thrust bearing 105*b*.

Additionally, a suction port 105*c* into which the process gas G is made to flow from the outside is provided on the side of one end of the casing 105 in the axial direction, and a discharge port 105*d* through which the process gas G flows to the outside is provided on the side of the other end. An internal space, which communicates with the suction port 105*c* and the discharge port 105*d*, respectively, and repeats diameter enlargement and diameter reduction, is provided in the casing 105. This internal space functions as a space that accommodates the impeller 1, and also functions as the above flow passage 104.

That is, the suction port 105*c* and the discharge port 105*d* communicate with each other via the impeller 1 and the flow passage 104.

A plurality of the impellers 1 is arranged at intervals in the axial direction of the shaft 102. In addition, although six impellers 1 are provided in the illustrated example, it is only necessary that at least one or more impellers are provided.

FIGS. 2 to 5 show the impeller 1 of the centrifugal compressor 100, and the impeller 1 includes a hub 2 and a plurality of blades 3.

Figure 3:
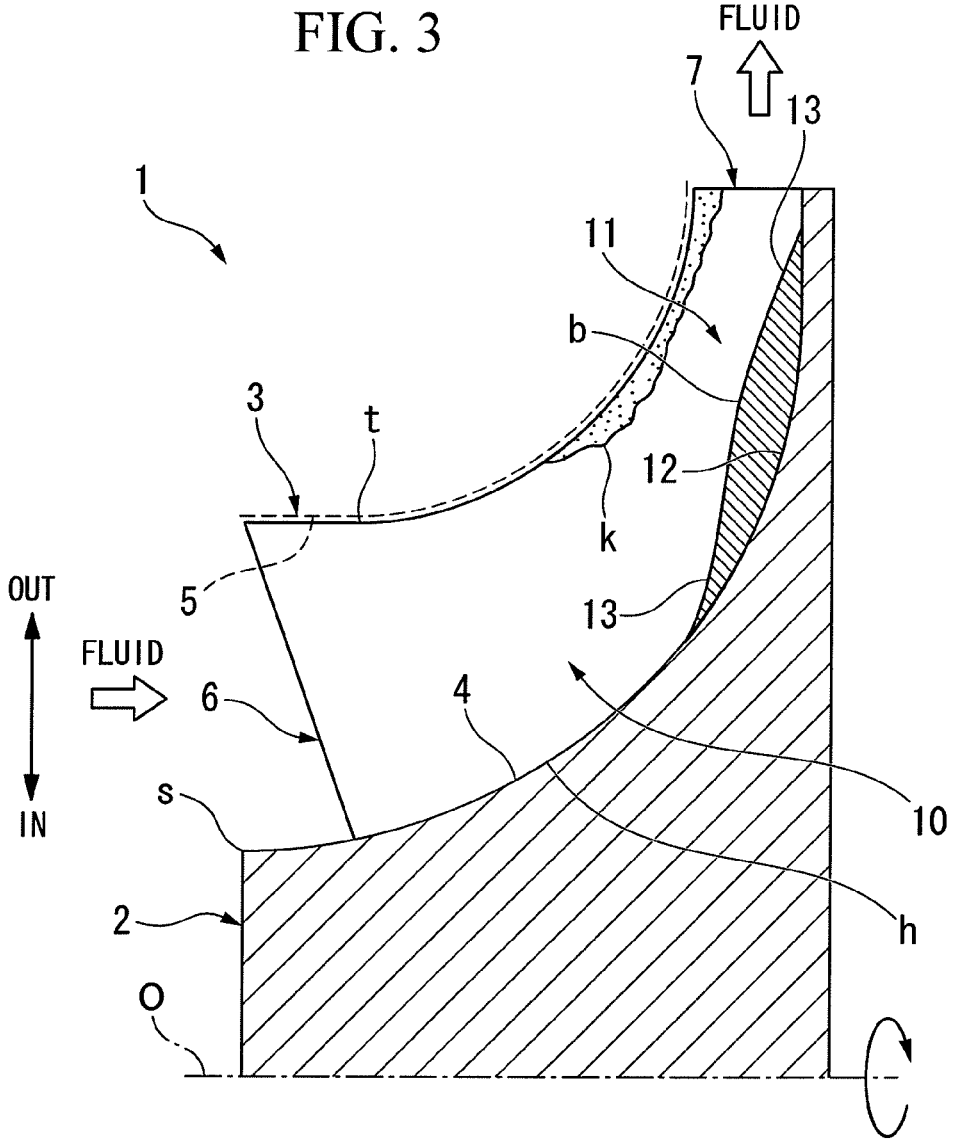
FIG. 3 is a sectional view taken along a line A-A of FIG. 2.

The hub 2 is formed in a substantially round shape in front view, and is made rotatable around the axis with the axis O as a center. In the hub 2, as shown in FIG. 3, a hub surface 4 is formed so as to be curved toward the outside in the radial direction from a predetermined position S on the inside in the radial direction slightly separated radially outward from the axis O. This curvedly formed hub surface 4 is formed such that a surface located on the inside in the radial direction is formed along the axis O, and runs along the radial direction gradually as it goes to the outside in the radial direction. That is, the hub 2 is formed such that the axial thickness thereof decreases from one (upstream) of the axial end surfaces as it goes to the outside in the radial direction from the position S on the inside in the radial direction slightly separated from the axis O, and this axial thickness becomes larger near the inside and becomes smaller near the outside. In addition, in FIG. 3, an arrow indicates the radial direction of the hub 2.

Figure 2:
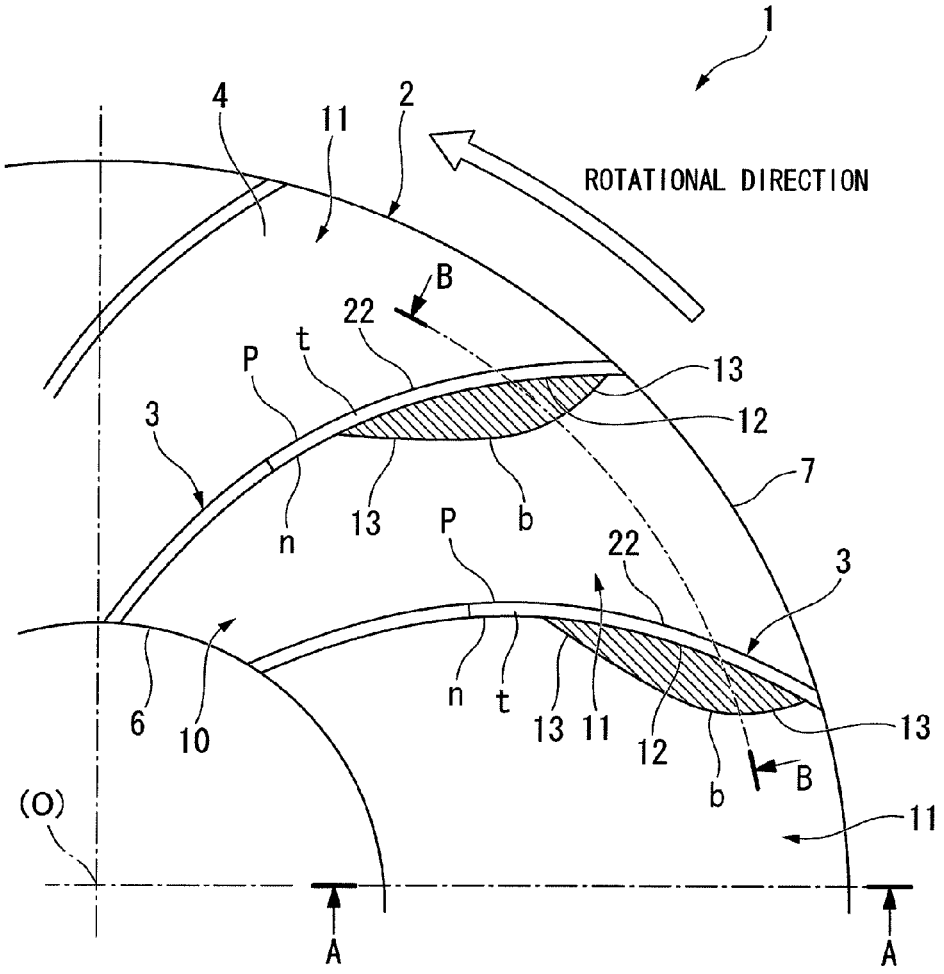
FIG. 2 is an enlarged front view showing chief parts of the impeller in the embodiment of the invention.
Figure 4:
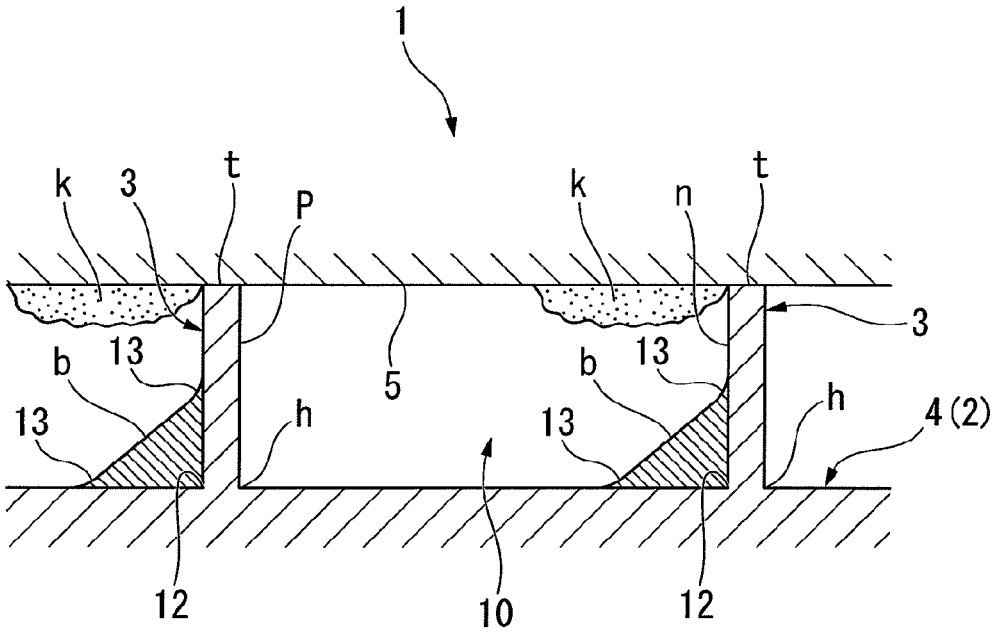
FIG. 4 is a sectional view along a line B-B of FIG. 2.

A plurality of blades 3 is substantially radially arranged on the above-described hub surface 4 as shown in FIG. 2, and is erected substantially perpendicularly to the hub surface 4 as shown in FIG. 4. The blade 3 shows a curved shape that slightly becomes a convex surface toward the rotational direction (shown by an arrow in FIG. 2). As the impeller 1 rotates, the convex side of the curved blade 3 becomes a pressure surface p, and a blade surface on the concave side that is a back side of the convex surface becomes the suction surface n.

Additionally, as shown in FIG. 3, the tip end t of a blade 3 is formed so as to be curved from the inside in the radial direction to the outside in the radial direction thereof. More specifically, similarly to the above-described hub surface 4, the blade is formed in a concave shape that runs along the axis O nearer the inside in the radial direction and runs along the radial direction gradually as it goes to the outside in the radial direction.

If the hub surface 4 is taken as a reference, the blade 3 is formed so as to be higher near the inside in the radial direction of the hub 2 and lower near the outside in the radial direction thereof.

In the above-described impeller 1, the tip end t side of the blade 3 is covered with the casing 105 (refer to FIG. 1), and an impeller flow passage 10 of the impeller 1 is constituted by a shroud surface 5 constituted by the casing 105, the pressure surface p and suction surface n of adjacent blades 3 described above, and the hub surface 4 between the pressure surface p and the suction surface n. As the impeller 1 rotates, a fluid flows in along the radial direction from an inlet 6 of the impeller flow passage 10 located on the inside in the radial direction of the hub 2, and the fluid flows out to the outside along the radial direction from an outlet 7 located on the outside in the radial direction due to a centrifugal force.

The impeller flow passage 10 having the configuration described above is formed so as to be curved from the above-described inlet 6 toward the outlet 7, and the direction of flow of the flow passage gradually changes from the axial direction to the radial direction as it goes from the inside in the radial direction of the hub 2 to the outside in the radial direction thereof. As the impeller flow passage 10 is curved in this way, a stagnation k of a low-energy fluid (refer to FIGS. 3 and 4) is easily accumulated on the shroud surface 5 side near the suction surface n of a rear half 11 on the outlet 7 side of the impeller flow passage 10.

In the rear half 11 of the impeller flow passage 10, a bulge b that bulges toward the inside of the impeller flow passage 10 is formed at a corner 12 where the hub surface 4 comes in contact with the suction surface n of the blade 3. The bulge b is formed integrally with the hub surface 4 and the suction surface n (refer to FIGS. 2 and 4). By providing the bulge b, the stagnation k with a low-energy fluid in the rear half 11 of the impeller flow passage 10 is pressed against a high-energy fluid that has ridden over the bulge b and is reduced.

The maximum width of the bulge b, is set to about 25% of the width of the impeller flow passage 10, and to about 30% of the height of the blade 3. It is desirable to have a maximum width and a maximum height at a position of about 65% of the flow passage length from the inlet 6 of the impeller flow passage 10 to the outlet 7 thereof. A scraped portion 13 that smoothly connects the hub surface 4 and the suction surface n together is provided around the bulge b.

On the inlet 6 side of the impeller flow passage 10, the width and height of the scraped portion 13 gradually increase toward the outlet 7 side with reference to the suction surface n from a position of about 30% of the flow passage length, and is connected to the bulge b. Moreover, on the outlet 7 side of the bulge b, the width and height of the scraped portion gradually decrease in the direction of the outlet 7, and the width and height converge on the suction surface n at the outlet 7 and return to 0, in consideration of a connection or the like to a diffuser (not shown) that is arranged in a latter stage of the impeller 1. In addition, the shape and position of the bulge b described above are an example, and are not limited to the above position, and the starting position of the scraped portion 13 is not limited to the above position either.

Figure 5:
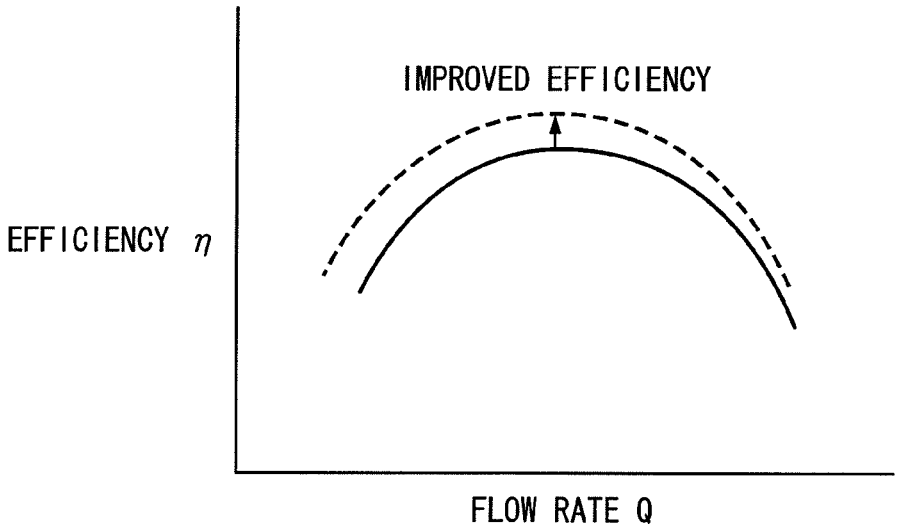
FIG. 5 is a graph showing efficiency characteristics with respect to the flow rate of the impeller in the embodiment of the invention.

FIG. 5 is a graph showing the efficiency characteristics of rotary machines using the impeller 1 and a related-art impeller. In this graph, the vertical axis represents efficiency and the horizontal axis represents flow rate Q. In addition, in FIG. 5, a solid line shows the efficiency of a rotary machine including an impeller that is not provided with the bulge b, and a broken line shows the efficiency of a rotary machine including the above-described impeller 1 that is provided with the bulge b.

As shown in FIG. 5, it is apparent that the efficiency is improved in a case where the bulge b is provided at the same flow rate Q, as compared to a case where the bulge b is not provided. Particularly, it is apparent that the efficiency on the side of a small flow rate is improved greatly.

Figure 6:
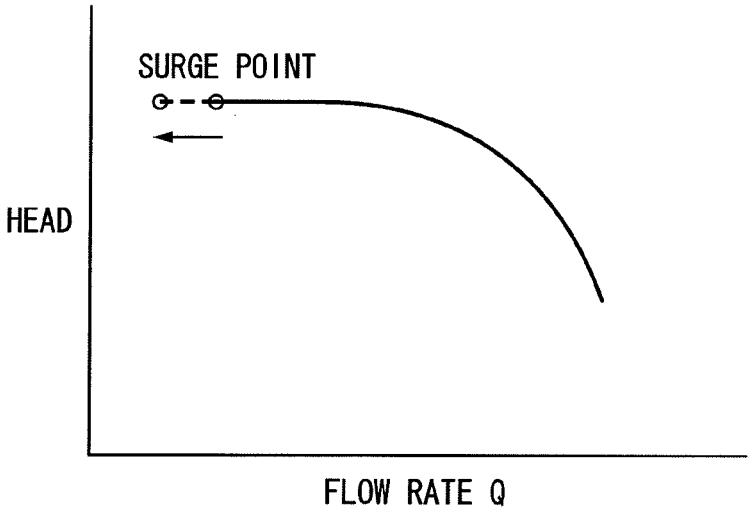
FIG. 6 is graph showing head characteristics with respect to the flow rate of the impeller in the embodiment of the invention.

Additionally, FIG. 6 is a graph showing the head (work) characteristics of the rotary machines using the impeller 1 and the related-art impeller, and the vertical axis represents head (work), and the horizontal axis represents the flow rate Q. In addition, in FIG. 6, a solid line shows the head of a rotary machine including an impeller that is not provided with the bulge b, and a broken line shows the head of a rotary machine including the above-described impeller 1 that is provided with the bulge b.

As shown in FIG. 6, it is apparent that a surge point (shown by an open circle in the thawing) of the rotary machine including the above-described impeller 1 that is provided with the bulge b is displaced toward a lower flow rate side more than a surge point of the rotary machine including the impeller that is not provided with the bulge b (shown by a filled circle in the drawing), and a surge margin is expanded.

In FIGS. 5 and 6, the reason why the efficiency is improved and the flow rate of the surge point is lowered is that the stagnation k with a low-energy fluid in the rear half 11 of the impeller flow passage 10 is pressed against a high-energy fluid that has ridden over the bulge b and is reduced, and the stall of the fluid is suppressed. In addition, the surge point is a minimum flow rate at which a rotary machine is required to operate normally without surging.

Accordingly, according to the impeller 1 of the rotary machine of the above-described embodiment, the bulge b is provided so as to bulge toward the inside of the impeller flow passage 10 from the corner 12 where the hub surface 4 comes in contact with the suction surface n of the blade 3 in the rear half 11 of the impeller flow passage 10. Thereby, the fluid that flows through the impeller flow passage 10 flows over the bulge b in the rear half 11. Since the high-energy fluid that has ridden over the bulge b is pressed against the stagnation k of the low-energy fluid that is produced in a facing surface of the bulge b and the stagnation k of the low-energy fluid is reduced, a flow loss caused by accumulation of the stagnation k of the low-energy fluid can be reduced.

Moreover, although the stagnation k of the low-energy fluid tends to increase as the flow rate decreases, the flow velocity is increased by the bulge b. Thus, particularly when a fluid with a low flow rate flows in, the efficiency is improved, and stall of the fluid is further suppressed. Thus, the surge margin is also expanded.

Additionally, the strength of the portion where the blade 3 formed with the bulge b comes in contact with the hub 2 can be increased by providing the bulge b at the corner 12. Moreover, an increase in the number of parts can be suppressed by forming the hub 2 and the blade 3 integrally with the bulge b.

Additionally, since the bulge b is provided at the corner 12 where the suction surface n, which is relatively close to the portion where the stagnation k of the low-energy fluid near the corner between the suction surface n of the blade 3 and the shroud surface 5 on the tip end t side is accumulated, comes in contact with the hub surface 4, the stagnation k of the low-energy fluid can be efficiently pressed by the high-energy fluid that has ridden over the bulge b, and can be reduced.

Moreover, since the bulge b, the hub surface 4, and the suction surface n are smoothly connected together by the scraped portion 13, the loss when the high-energy fluid flows over the bulge b can be suppressed.

Figure 7:
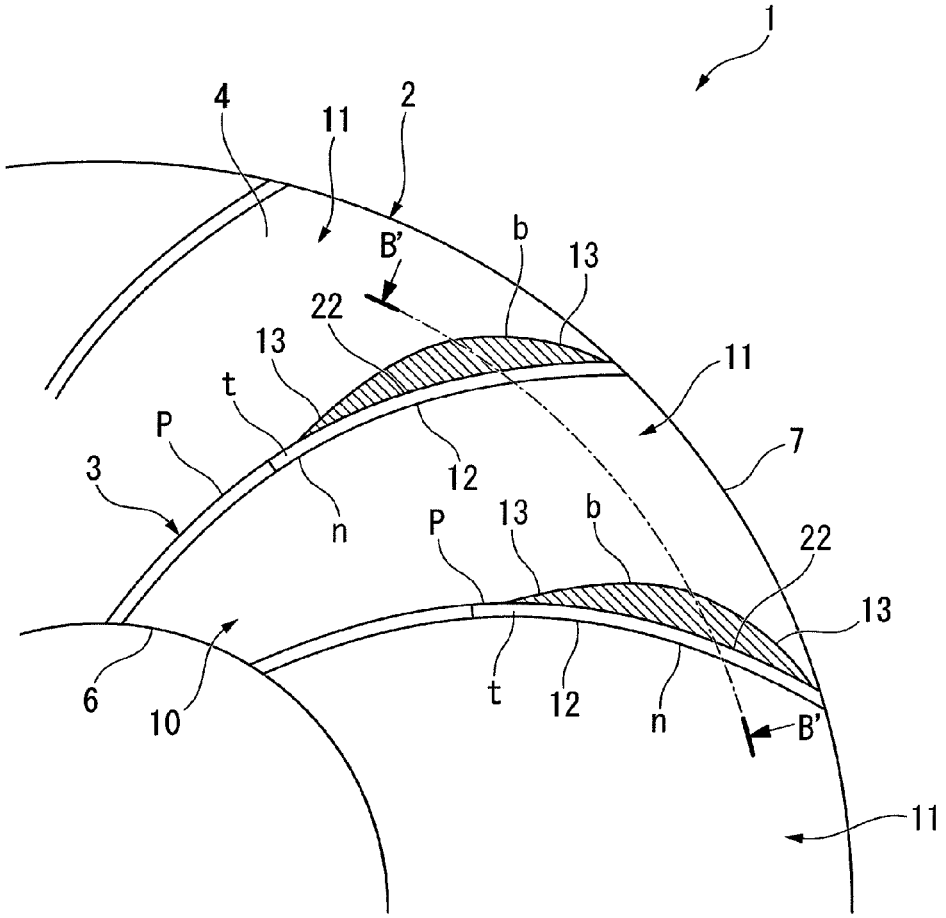
FIG. 7 is a front view of an impeller in another example of the embodiment of the invention.
Figure 8:
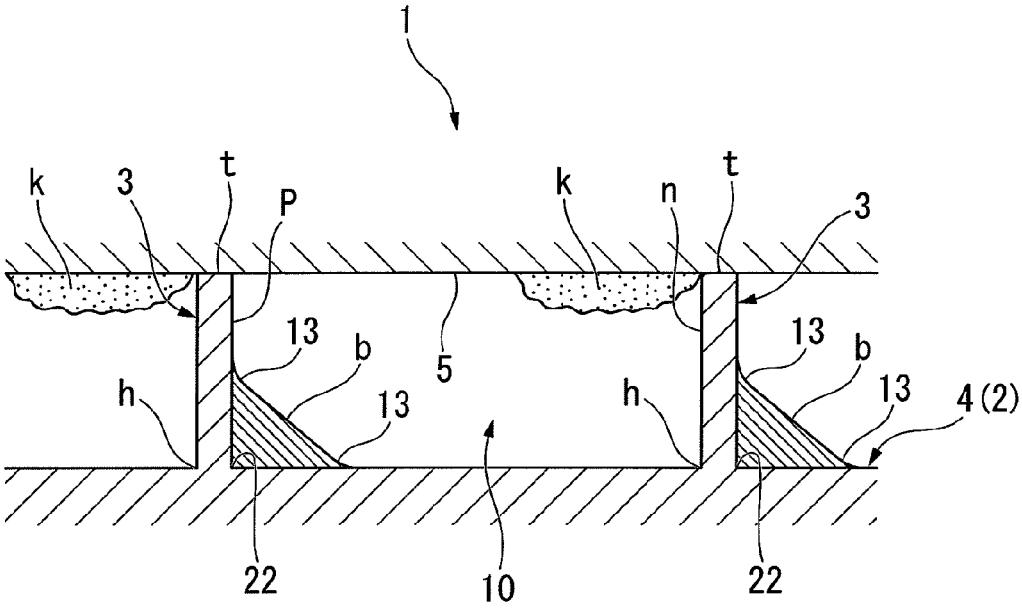
FIG. 8 is a sectional view taken along a line B'-B' of FIG. 7.
Figure 9:
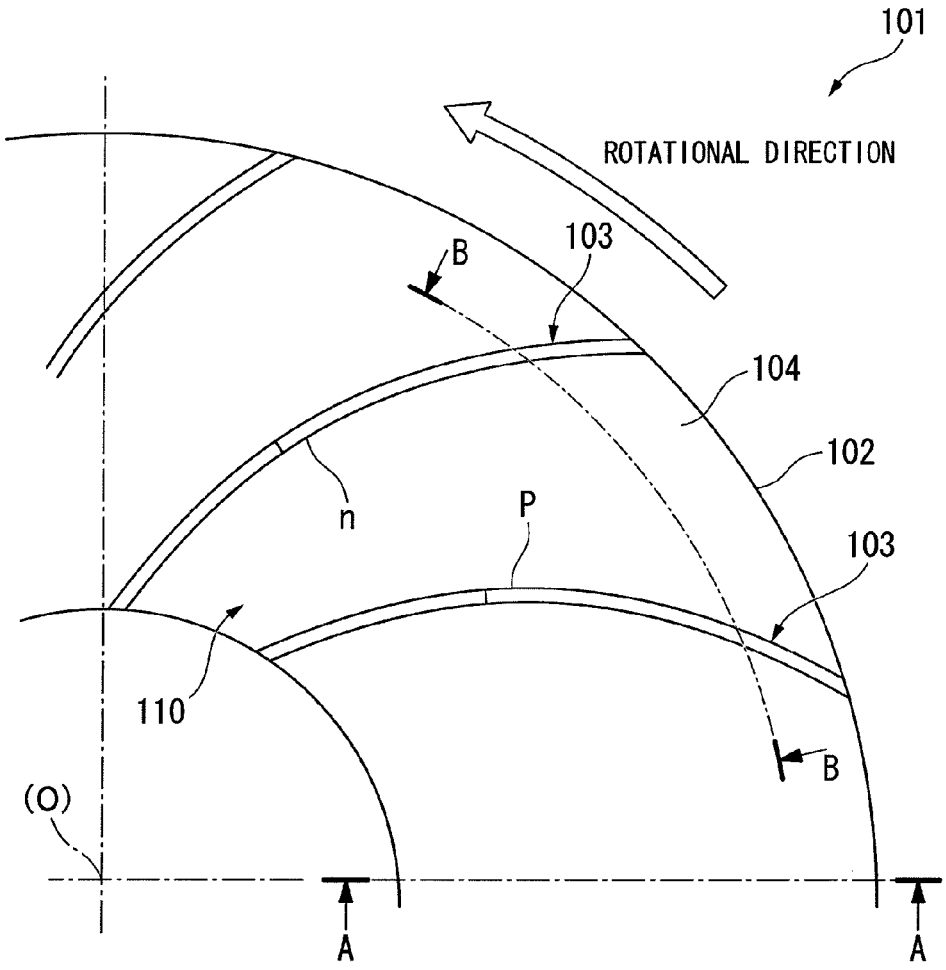
FIG. 9 is a front view equivalent to FIG. 2 in a related-art impeller.
Figure 10:
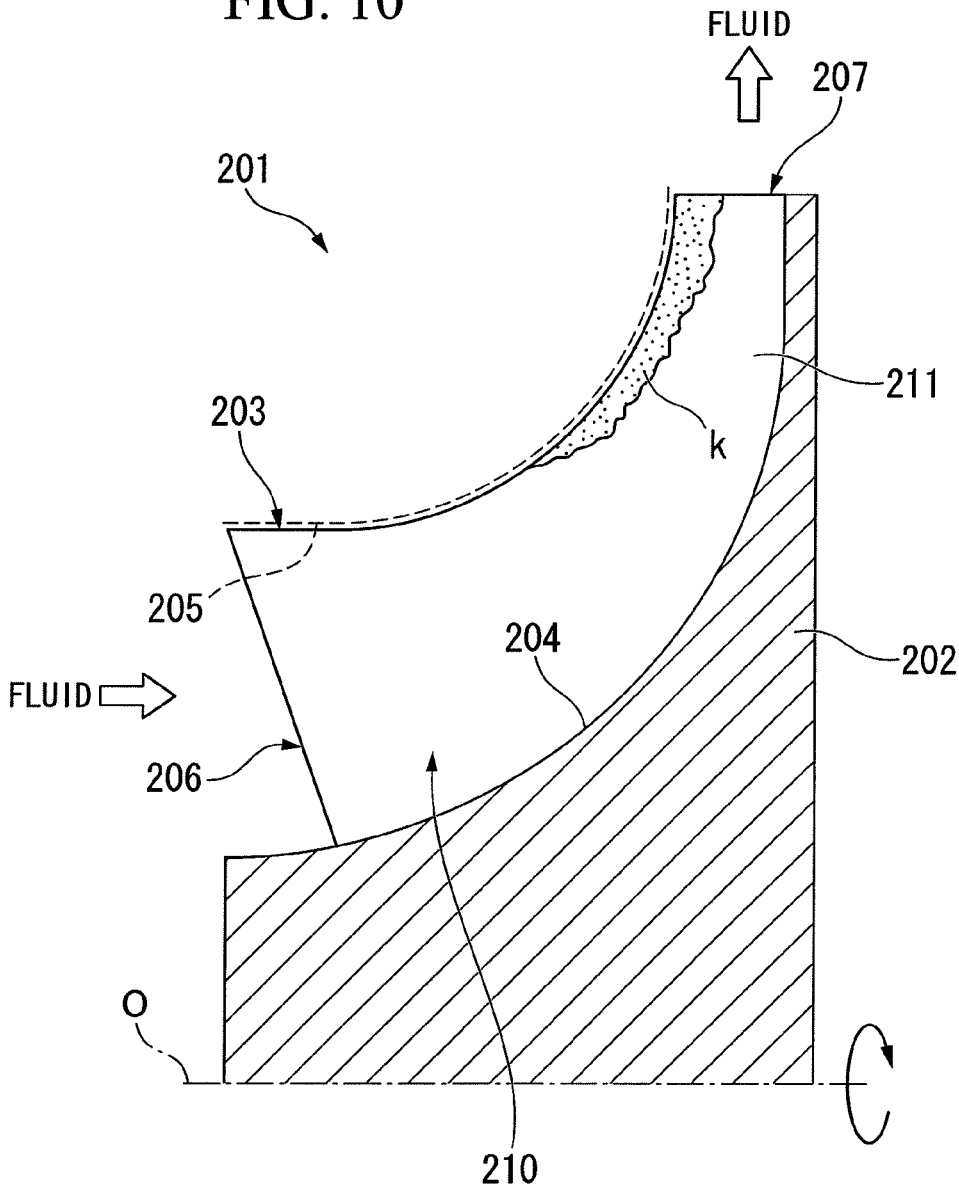
FIG. 10 is a sectional view taken along a line A-A of FIG. 9.
Figure 11:
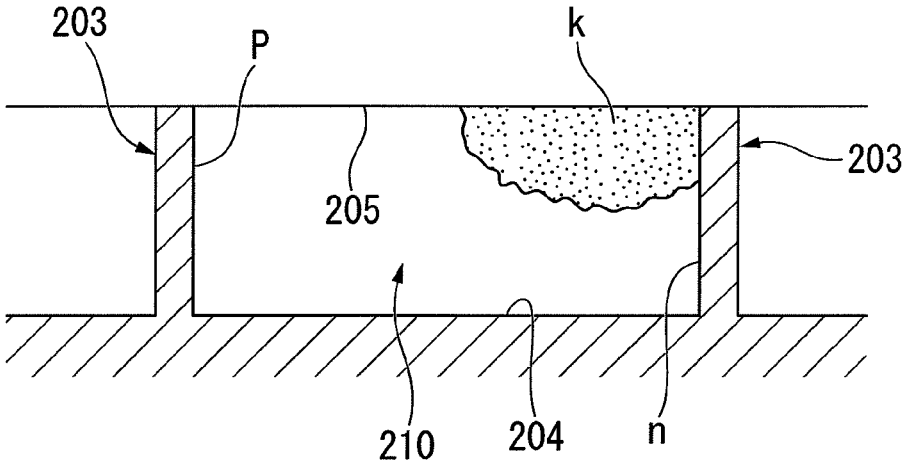
FIG. 11 is a sectional view along a line B-B of FIG. 9.

In addition, in the impeller 1 of the above-described embodiment, the case where the bulge b is provided at the corner 12 where the suction surface n located at the rear half 11 of the impeller flow passage 10 comes in contact with the hub surface 4 has been described; however, the invention is not limited to this configuration. For example, as another example, as shown in FIGS. 7 and 8, the bulge b may be provided at the corner 22 where the pressure surface p located at the rear half 11 of the impeller flow passage 10 comes in contact with the hub surface 4. Even in a case where the bulge b is provided at the corner 22, the high-energy fluid that has ridden over the bulge b can be pressed against the stagnation k of the low-energy fluid that is accumulated near the corner between the suction surface n of the blade 3, and the shroud surface 5, and the stagnation k of the low-energy fluid is reduced. Therefore, a flow loss caused by accumulation of the stagnation k of the low-energy fluid can be reduced.

Additionally, the shape and position of the bulge b of the above-described embodiment are an example, and are not limited to this. Additionally, the scraped portion 13 is not limited to this, similarly.

Additionally, although the impeller of the centrifugal rotary machine has been described in the above embodiment, the impeller is not limited to this, and may be an impeller of a mixed-flow rotary machine. Additionally, the invention may be applied to an impeller of a blower, a turbine, or the like without being limited to the compressor. Additionally, although the so-called open impeller in which the facing side of the hub surface 4 is covered with the shroud surface 5 has been described as an example in the above-described embodiment, the invention may be applied to a closed impeller including a wall that covers the tip end t side integrally formed in the blade 3. In the case of this closed type impeller, it is only necessary to substitute the shroud surface 5 of the above-described embodiment with the inner surface side of the wall that covers the tip end t. In addition, as in the related art, a fillet R formed by the tip roundness of a cutting cutter tool is slightly given to a boundary portion between the hub surface 4 other than the bulge b, and a blade surface (the suction surface n or the pressure surface p).

INDUSTRIAL APPLICABILITY

According to the impeller and rotary machine related to the invention, by providing the bulge at the corner where the hub surface comes in contact with the blade surface, the stagnation of the low-energy fluid produced along the shroud surface near the suction surface of the blade of the rear half of the fluid flow passage can be reduced when a fluid that flows through the fluid flow passage flows over the bulge. Therefore, a flow loss caused as the stagnation of the low-energy fluid expands can be reduced.

REFERENCE SIGNS LIST

1: IMPELLER
4: HUB SURFACE
6: INLET
7: OUTLET
10: IMPELLER FLOW PASSAGE (FLUID FLOW PASSAGE)
12: CORNER
13: SCRAPED PORTION
22: CORNER
100: CENTRIFUGAL COMPRESSOR
p: PRESSURE SURFACE (BLADE SURFACE)
n: SUCTION SURFACE (BLADE SURFACE)
b: BULGE

The invention claimed is:

1. An impeller of a rotary machine, in which a direction of flow is configured to gradually change from an axial direction to a radial direction as the flow goes from an interior in the radial direction of a fluid flow passage to an exterior in the radial direction of the fluid flow passage, the impeller comprising:

a hub surface defining at least a portion of the fluid flow passage;

a blade surface defining at least a portion of the fluid flow passage; and a bulge disposed at a corner formed by the hub surface and the blade surface, the bulge being disposed at an acute angle with respect to both of the hub surface and the blade surface, the bulge being located at a rear half on an outlet side of the fluid flow passage, and the bulge being disposed so as to bulge toward the interior of the fluid flow passage from the corner.

2. The impeller according to claim 1, wherein the corner is defined by a suction surface of the blade, and the hub surface.

3. The impeller according to claim 1, wherein the corner is defined by a pressure surface of the blade, and the hub surface.

4. The impeller according to claim 1, wherein a scraped portion is disposed on either an upstream side or a downstream side of the fluid flow passage in the bulge so as to smoothly connect the bulge, and the hub surface and the blade surface.

5. The impeller according to claim 2, wherein a scraped portion is disposed on either an upstream side or a downstream side of the fluid flow passage in the bulge so as to smoothly connect the bulge, and the hub surface and the blade surface.

6. The impeller according to claim 3, wherein a scraped portion is disposed on either an upstream side or a downstream side of the fluid flow passage in the bulge so as to smoothly connect the bulge, and the hub surface and the blade surface.

7. A rotary machine comprising the impeller according to claim 1.

8. A rotary machine comprising the impeller according to claim 2.

9. A rotary machine comprising the impeller according to claim 3.

10. A rotary machine comprising the impeller according to claim 4.

11. A rotary machine comprising the impeller according to claim 5.

12. A rotary machine comprising the impeller according to claim 6.

13. The impeller according to claim 1, wherein the bulge, the hub surface, and the blade surface are monolithic.

14. A rotary machine comprising the impeller according to claim 13.

15. The impeller according to claim 1, wherein the bulge fills a corner formed by the hub surface and the blade surface.

16. A rotary machine comprising the impeller according to claim 15.

17. The impeller according to claim 1, wherein the bulge is in contact with both of the hub surface and the blade surface.

18. A rotary machine comprising the impeller according to claim 17.

* * * * *